US005885438A

United States Patent [19]

Apelian et al.

[11] Patent Number: 5,885,438

[45] Date of Patent: Mar. 23, 1999

[54] WAX HYDROISOMERIZATION PROCESS

[75] Inventors: Minas R. Apelian, Vincentown, N.J.; William S. Borghard, Yardley, Pa.; Thomas F. Degnan, Jr., Moorestown, N.J.; Robert T. Hanlon, Glen Mills; Mae K. Rubin, Bala Cynwyd, both of Pa.

[73] Assignee: Mobil Oil Corporation, Fairfax, Va.

[21] Appl. No.: 623,084

[22] Filed: Mar. 28, 1996

(Under 37 CFR 1.47)

Related U.S. Application Data

[63] Continuation-in-part of Ser. No. 017,955, Feb. 12, 1993, abandoned, and Ser. No. 017,949, Feb. 12, 1993, abandoned.

[51] Int. Cl.[6] ..... C10G 65/12

[52] U.S. Cl. ..... 208/27; 208/18; 208/49; 208/58; 208/96; 208/59; 208/97; 585/739

[58] Field of Search ..... 208/111, 87, 27, 208/49, 58, 59, 96, 97; 585/739

[56] References Cited

U.S. PATENT DOCUMENTS

| | | | |
|---|---|---|---|
| 4,419,270 | 12/1983 | LaPierre et al. | 208/111 |
| 4,975,172 | 12/1990 | Gawood | 208/27 |
| 5,164,169 | 11/1992 | Rubin | 423/709 |
| 5,200,168 | 4/1993 | Apellian et al. | 423/714 |
| 5,232,579 | 8/1993 | Absil et al. | 208/113 |
| 5,238,677 | 8/1993 | Apelian | 423/714 |
| 5,302,279 | 4/1994 | Degnan | 208/87 |

*Primary Examiner*—Helane Myers
*Attorney, Agent, or Firm*—Penny L. Prater; Malcolm D. Keen

[57] ABSTRACT

This invention discloses a process for producing a high Viscosity Index lubricant having a VI of at least 125 from a waxy hydrocarbon feed having a wax content of at least 40 wt %. The process comprises catalytically dewaxing waxy paraffins present in the feed by isomerization in the presence of hydrogen and in the presence of a low acidity large pore zeolite isomerization catalyst. This catalyst has a ratio of $SiO_2/Al_2O_3$, as synthesized, of at least 50:1, wherein the catalyst is prepared in the absence of boron. The alpha value of the catalyst is no greater than 20. The catalyst comprises a noble metal hydroisomerization catalyst such as Pt. The feed may be hydrocracked prior to dewaxing with the large pore zeolite. The effluent of the process may also be further dewaxed by either solvent or catalytic means in order to achieve target pour point.

29 Claims, No Drawings

WAX HYDROISOMERIZATION PROCESS

CROSS-REFERENCE TO RELATED APPLICATIONS

The instant application is a continuation-in-part of Ser. No. 08/017,955 now abandoned. The instant application is also a continuation-in-part of Ser. No. 08/017,949 now abandoned. Ser. No. 08/017,955 now abandoned is incorporated by reference in the instant application. Corresponding European Patent No. 464,547A1, (a patent which specifies the use of low acidity zeolite beta for wax isomerization) is also incorporated by reference. The instant application is related to co-pending application Ser. No. 08/303,091 in which two dewaxing catalysts operate synergistically to produce a lubricant of high Viscosity Index. It is also related to Ser. No. 08/329,914, which is concerned with isomerizing petroleum waxes using large pore zeolites of small crystallite size.

This application is related to co-pending application Ser. No. 08/017,948 (continuation of Ser. No. 07/548,702) now abandoned entitled Production of High Viscosity Index Lubricants, which describes a two-step process for producing high Viscosity Index lubricants by hydrocracking and hydroisomerization of petroleum wax feeds using a low acidity zeolite beta hydroisomerization catalyst. Ser. No. 08/017,955, also entitled Production of High Viscosity Index Lubricants, describes a wax hydroisomerization process using zeolite catalysts of controlled low acidity at high pressures.

FIELD OF THE INVENTION

This invention relates to the production of high Viscosity Index lubricants by isomerizing petroleum waxes using boron-free zeolites with high $SiO_2/Al_2O_3$ ratios. The waxes may be hydrocracked prior to isomerization. The isomerization product may be further dewaxed by either solvent or catalytic means in order to achieve a target pour point.

BACKGROUND OF THE INVENTION

Mineral oil based lubricants are conventionally produced by a separative sequence carried out in the petroleum refinery which comprises fractionation of a paraffinic crude oil under atmospheric pressure followed by fractionation under vacuum to produce distillate fractions (neutral oils) and a residual fraction which, after deasphalting and severe solvent treatment may also be used as a lubricant basestock. This refined residual fraction is usually referred to as bright stock. Neutral oils, after solvent extraction to remove low viscosity index (V.I.) components, are conventionally subjected to dewaxing, either by solvent or catalytic dewaxing processes, to achieve the desired pour point. The dewaxed lube stock may be hydrofinished to improve stability and remove color bodies. Viscosity Index (V.I.) is a reflection of the amount of viscosity decrease a lubricant undergoes with an increase in temperature. The products of solvent dewaxing are dewaxed lube oil and slack wax. Slack wax typically contains 60% to 90% wax with the balance being entrained oil. In some instances it is desirable to purify the slack wax of entrained oil by subjecting the slack wax to a deoiling step in which the slack wax is diluted with dewaxing solvents and filtered at a temperature higher than that used in the filtering step used to produce the slack wax. The purified wax is termed deoiled wax, and contains greater than 95% wax. The byproduct of the second filtration typically contains 50% wax and is termed foots oil.

Catalytic dewaxing of lube stocks is accomplished by converting waxy molecules to light products by cracking, or by isomerizing waxy molecules to form species which remain in the dewaxed lube. Dewaxing catalysts preserve high yield primarily by having pore structures which inhibit cracking of cyclic and highly branched species, those generally associated with dewaxed lube, while permitting easier access to catalytically active sites to near-linear molecules, of which wax is generally composed. Catalysts which significantly reduce the accessibility of species on the basis of molecular size are termed shape selective. Increasing the shape selectivity of a dewaxing catalyst will frequently increase the yield of dewaxed oil.

The shape selectivity of a dewaxing catalyst is limited practically by its ability to convert waxy molecules which have a slightly branched structure. These types of species are more commonly associated with heavier lube stocks, such as bright stocks. Highly shape selective dewaxing catalysts may be unable to convert heavy, branched wax species leading to a hazy lube appearance at ambient temperature and high cloud point relative to pour point.

Conventional lube refining techniques rely upon the proper selection and use of crude stocks, usually of a paraffinic character, which produce lube fractions with desired qualities in adequate amounts. The range of permissible crude sources may, however, be extended by the lube hydrocracking process which is capable of utilizing crude stocks of marginal or poor quality, usually with a higher aromatic content than the better paraffinic crudes. The lube hydrocracking process, which is well established in the petroleum refining industry, generally comprises an initial hydrocracking step carried out under high pressure, at high temperature, and in the presence of a bifunctional catalyst which effects partial saturation and ring opening of the aromatic components which are present in the feed. The hydrocracked product is then subjected to dewaxing in order to reach the target pour point since the hydrocracked product usually contains species with relatively high pour points. Frequently the liquid product from the dewaxing step is subjected to a low temperature, high pressure hydrotreating step to reduce the aromatic content of the lube to the desired level.

Current trends in the design of automotive engines are associated with higher operating temperatures as the efficiency of the engines increases. These higher operating temperatures require successively higher quality lubricants. One of the requirements is for higher viscosity indices (V.I.) in order to reduce the effects of the higher operating temperatures on the viscosity of the engine lubricants. High V.I. values have conventionally been attained by the use of V.I. improvers e.g. polyacrylates and polystyrenes. V.I. improvers tend to undergo degradation due to high temperatures and high shear rates encountered in the engine. The more stressing conditions encountered in high efficiency engines result in even faster degradation of oils which employ significant amounts of V.I. improvers. Thus, there is a continuing need for automotive lubricants which are based on fluids of high Viscosity Index and which are resistant to the high temperature, high shear rate conditions encountered in modern engines.

Synthetic lubricants produced by the polymerization of olefins in the presence of certain catalysts have been shown to possess excellent V.I. values, but they are relatively expensive to produce. There is therefore a need for the production of high V.I. lubricants from mineral oil stocks which may be produced by techniques comparable to those presently employed in petroleum refineries.

U.S. Pat. No. 4,975,177 discloses a two-stage dewaxing process for producing lube stocks of high V.I. from waxy feedstocks. In the first stage of this process, the waxy feed is catalytically dewaxed by isomerization over zeolite beta. The product of the isomerization step still contains waxy species and requires further dewaxing to meet target pour point. The second-stage dewaxing employs either solvent dewaxing, in which case the rejected wax may be recycled to the isomerization stage to maximize yield, or catalytic dewaxing. Catalysts which may be used in the second stage are ZSM-5, ZSM-22, ZSM-23, and ZSM-35. To preserve yield and V.I., the second stage dewaxing catalyst should have selectivity similar to solvent dewaxing. U.S. Pat. No. 4,919,788 also teaches a two-stage dewaxing process in which a waxy feed is partially dewaxed by isomerization over a siliceous Y or beta catalyst with the product subsequently dewaxed to desired pour point using either solvent dewaxing or catalytic dewaxing. Dewaxing catalysts with high shape selectivity, such as ZSM-22 and ZSM-23, are preferred catalysts. These examples, however, do not teach synergistic effects involving more than one dewaxing catalyst.

Ser. No. 08/017,949 discloses a two stage hydrocracking and hydroisomerization process. The first stage employs a bifunctional catalyst comprising a metal hydrogenation component on an amorphous acidic support. The second stage, the hydroisomerization step, is carried out over zeolite beta. Subsequent dewaxing is optional but recommended. Either solvent dewaxing or catalytic dewaxing maybe used subsequently in order to obtain target V.I. and pour point. There is no teaching of catalytic synergism in this invention.

In Ser. No. 08/017,955, petroleum wax feed is subjected to hydroisomerization over a noble metal-containing zeolite catalyst of low acidity. The paraffins present in the feed are selectively converted to iso-paraffins of high V.I. but lower pour point so that a final lube product of good viscometric properties is produced with a minimal degree of subsequent dewaxing. The process, which operates under high pressure, is well suited for upgrading waxy feeds such as slack wax with aromatic contents greater than about 15 wt. % to high Viscosity Index lubricating oils with high single pass yields and limited requirement for product dewaxing.

Related cases primarily emphasize solvent dewaxing with Catalytic dewaxing as a possible alternative or secondary step. The advantage of solvent dewaxing the product of the isomerization stage in that wax is rejected and can be recycled to the isomerization catalyst to improve the yield of high V.I. lube. However, operational costs for solvent dewaxing are higher than for catalytic dewaxing. Additionally, the pour point of the solvent dewaxed lube stock is restricted by solvent refrigeration capability to approximately −5° to 0° F. Catalytic dewaxing enables production of high V.I. lubes having pour points significantly lower than those possible for solvent dewaxing. An unexpected development of the total catalytic dewaxing process is that it can produce lubricants with equivalent or higher V.I. at equivalent or lower pour points than lubricants produced by solvent dewaxing. U.S. Pat. No. 5,302,279 (and the analogous European patent application EP 464 547 A1) teaches the use of a low acidity form of zeolite beta for isomerizing and dewaxing furfural raffinates. The improved selectivity of a catalyst of low acidity over one of high acidity was demonstrated in the examples.

SUMMARY OF THE INVENTION

The concept of the instant invention involves a process for dewaxing waxy feedstocks using as catalysts large pore zeolites having low acidity and possessing at least one Group VIII metal without the use of boron. The Group VIII metal is preferably a noble metal such as Pt or Pd. A high silica large pore zeolite which has been synthesized to possess a $SiO_2/Al_2O_3$ ratio of 200 or greater and preferably, 400 or greater, is used in this invention. This zeolite is prepared in the absence of boron. Large pore zeolites applicable to this invention are defined as having a Constraint Index less than one and include zeolite beta, Y and mordenites along with MCM-22. Large pore zeolites have accessible pore structures for forming highly branched paraffins from waxy feed stocks. Such branched paraffins have a high VI and low pour point. If the zeolite possesses a high silica/alumina ratio as described in this invention, yield and VI are improved, because undesirable cracking is reduced.

The instant invention involves processing a waxy hydrocarbon feedstock over an isomerization catalyst which converts waxy species to branched paraffins. The formation of these branched paraffins which have high VI and low pour points, results in a lubricant base stock having superior quality.

The feedstocks used in this invention preferably contain more than 40% wax. The feedstock may be pretreated, preferably by mild hydrocracking, prior to the isomerization step to remove nitrogen and sulfur-containing species and to reduce its aromatics content. The raw or pretreated feedstock is contacted with the catalyst of this invention, a low-acidity boron-free large pore zeolite catalyst with a high silica/alumina ratio over which a substantial fraction of the wax in the feed is isomerized to form species typically associated with lube base stocks. A large pore catalyst is defined as one which has at least one channel comprising 12-membered oxygen rings. The isomerization step occurs typically at a pressure between 600 and 3000 psig. The effluent from the isomerization step may be hydrotreated to remove residual aromatics.

DETAILED DESCRIPTION OF THE INVENTION

In the present process feeds with a relatively high wax content are converted to high V.I. lubricants in a hydroisomerization process using a boron-free, low acidity zeolite hydroisomerization catalyst with a silica/alumina ratio greater than 200 and preferably greater than 400. The products are characterized by good viscometric properties including high Viscosity Index, typically at least 140 and usually in the range 143 to 147. Products of this invention maybe further dewaxed or hydrotreated.

Feed

The present process is capable of operating with a wide range of feeds of mineral oil origin to produce a range of lubricant products with good performance characteristics. Such characteristics include low pour point, low cloud point, and high Viscosity Index. The quality of the product and the yield in which it is obtained is dependent upon the quality of the feed and its amenability to processing by the catalysts of the instant invention. Products of the highest V.I. are obtained by using preferred wax feeds such as slack wax, deoiled wax or vacuum distillates derived from waxy crudes. Waxes produced by Fischer-Tropsch processing of synthesis gas may also be used as feedstocks. Products with lower V.I. values may also be obtained from other feeds which contain a lower initial quantity of waxy components. The feeds which may be used should have an initial boiling point which is no lower than the initial boiling point of the desired lubricant. A typical initial boiling point of the feed exceeds 650° F. (343° C.). Feeds of this type which may be used include vacuum gas oils as well as other high boiling fractions such as distillates from the vacuum distillation of atmospheric resids, raffinates from the solvent extraction of such distillate fractions, hydrocracked vacuum distillates and waxes from the solvent dewaxing of raffinates and hydrocrackates.

The feed may require preparation in order to be treated satisfactorily in hydroisomerization. The preparation steps which are generally necessary are those which remove low V.I. components such as aromatics and polycyclic naphthenes. Removal of these materials will result in a feed for the hydroisomerization step which contains higher quantities of waxy paraffins which are then converted to high V.I., low pour point iso-paraffins. Catalytic synergy is most dramatically illustrated for feedstocks having a wax content of over 50%, although feeds with lower wax contents may be used effectively.

Suitable pre-treatment steps for preparing feeds for the hydroisomerization are those which remove the aromatics and other low V.I. components from the initial feed. Hydrotreatment is an effective pretreatment step, particularly at high hydrogen pressures which are effective for aromatics saturation e.g. 800 psig (about 5,600 kPa) or higher. Mild hydrocracking may also be employed as pretreatment and is preferred in the instant invention, if pretreatment is required. Example 1, infra, discusses the hydrocracking conditions employed in the instant invention in order to prepare a feed for the dewaxing process. Pressures over 1000 psig are preferred for hydrocracking treatment. Hydrocracking removes nitrogen containing and sulfur-containing species and reduces aromatics content as Table 6 below illustrates. Hydrocracking, in this example, has also slightly altered the boiling range of the feed, causing it to boil in a lower range. Commercially available catalysts such as fluoride nickel-tungsten on fluorided alumina (NiW/F—$Al_2O_3$) may be employed for the hydrocracking pretreatment.

The preferred gas oil and vacuum distillate feeds are those which have a high wax content, as determined by ASTM D-3235, preferably over about 50 weight percent. Feeds of this type include certain South-East Asian and mainland China oils. Minas Gas Oil, from Indonesia, is such a feed. These feeds usually have a high paraffin content, as determined by a conventional analysis for paraffins, naphthenes, and aromatics. The properties of typical feeds of this type are set out in Ser. No. 07/017,955.

As stated previously, the wax content of the preferred feeds is high, generally at least 50 wt% (as determined by ASTM Test D-3235) prior to pretreatment. The wax content before pretreatment is more usually at least 60 to 80 weight percent with the balance being occluded oil comprising iso-paraffins, aromatics and naphthenics. These waxy, highly paraffinic wax stocks usually have low viscosities because of their relatively low content of aromatics and naphthenes although the high content of waxy paraffins gives them melting points and pour points which render them unacceptable as lubricants without further processing. Wax feeds are discussed further in Ser. No. 07/017,955.

The most preferred type of wax feeds are the slack waxes, (see Table 2, infra). These are the waxy products obtained directly from a solvent dewaxing process, e.g. an MEK or propane dewaxing process. The slack wax, which is a solid to semi-solid product, comprising primarily highly waxy paraffins (mostly n- and mono-methyl paraffins) together with occluded oil, may be used as such or it may be subjected to an initial deoiling step of a conventional character in order to remove the occluded oil. Removal of the oil results in a harder, more highly paraffinic wax which may then be used as the feed. The byproduct of the deoiling step is termed foots oil and may also be used as feed to the process. The Foots Oil contains most of the aromatics present in the original slack wax and with these aromatics, most of the heteroatoms. Slack wax and foots oil typically require pretreatment prior to catalytic dewaxing. The oil content of deoiled waxes may be quite low and for this purpose, measurement of the oil content by the technique of ASTM D721 may be required for reproducibility, since the D-3235 test referred to above tends to be less reliable at oil contents below about 15 weight percent. At oil contents below about 10 percent, however, the advantage of the present catalysts may not be as marked as with oil contents of from about 10 to 50 weight percent and for this reason, wax feeds conforming to this requirement will normally be employed.

The compositions of some typical waxes are given in Table 1 below. The letters A, B, C and D represent different feeds, with wax compositions varying from about 50 to over 90%.

TABLE 1

Wax Composition - Arab Light Crude

| | A | B | C | D |
|---|---|---|---|---|
| Paraffins, wt. pct. | 94.2 | 81.8 | 70.5 | 51.4 |
| Mono-naphthenes, wt. pct. | 2.6 | 11.0 | 6.3 | 16.5 |
| Poly-naphthenes, wt. pct. | 2.2 | 3.2 | 7.9 | 9.9 |
| Aromatics, wt. pct. | 1.0 | 4.0 | 15.3 | 22.2 |

A typical slack wax feed has the composition shown in Table 2 below. This slack wax is obtained from the solvent (MEK) dewaxing of a 300 SUS (65 cSt at 40° C.) neutral oil obtained from an Arab Light crude.

TABLE 2

Slack Wax Properties

| | |
|---|---|
| API | 39 |
| Hydrogen, wt. pct. | 15.14 |
| Sulfur, wt. pct. | 0.18 |
| Nitrogen, ppmw | 11 |
| Melting point, °C. (°F.) | 57 (135) |
| KV at 100° C., cSt | 5.168 |
| PNA, wt pct: | |
| Paraffins | 70.3 |
| Naphthenes | 13.6 |
| Aromatics | 16.3 |

Simulated Distillation:

| % | °C. | (°F.) |
|---|---|---|
| 5 | 375 | (710) |
| 10 | 413 | (775) |
| 30 | 440 | (825) |
| 50 | 460 | (860) |
| 70 | 482 | (900) |
| 90 | 500 | (932) |
| 95 | 507 | (945) |

Another slack wax suitable for use in the present process has the properties set out in Table 6 (Example 1) infra as part of Example 3. This wax is prepared by the solvent dewaxing of a heavy neutral furfural raffinate. As discussed previously, hydrocracking may be employed to prepare the slack wax for hydroisomerization.

Hydrocracking Process (Optional)

If hydrocracking is employed as a pretreatment step an amorphous bifunctional catalyst is preferably used to promote the saturation and ring opening of the low quality aromatic components in the feed to produce hydrocracked products which are relatively more paraffinic. Hydrocracking is carried out under high pressure to favor aromatics saturation but the boiling range conversion is maintained at a relatively low level in order to minimize cracking of the saturated components of the feed and of the products obtained from the saturation and ring opening of the aromatic materials. Consistent with these process objectives, the hydrogen pressure in the hydrocracking stage is at least 800 psig (about 5500 kPa abs.) and usually is in the range of 1,000 to 3,000 psig (about 6900 to 20700 kPa abs). Normally, hydrogen partial pressures of at least 1500 psig (about 10500 kPa abs.) are best in order to obtain a high level of aromatic saturation. Hydrogen circulation rates of at least about 1000 SCF/Bbl (about 180 n.l.l $^{-1}$.), preferably in the range of 2,000 to 8,000 SCF/Bbl (about 900 to 1800 n.l.l $^{-1}$) are suitable.

In the hydrocracking process, the conversion of the feed to products boiling below the lube boiling range, typically to 650° F.– (about 345° C.–) products is limited to no more than 50 weight percent of the feed and will usually be not more than 30 weight percent of the feed in order to maintain the desired high single pass yields which are characteristic of the process. The actual conversion is dependent on the quality of the feed with slack wax feeds requiring a lower conversion than petrolatum where it is necessary to remove more low quality polycyclic components. For slack wax feeds derived from the dewaxing of neutral stocks, the conversion to 650° F.– products will, for all practical purposes not be greater than 10 to 20 weight percent, with 5–15 weight percent being typical for most slack waxes. Higher conversions may be encountered with petrolatum feeds because they typically contain more low quality components. With petrolatum feeds, the hydrocracking conversion will typically be in the range of 15 to 25 weight percent to produce high VI products. The conversion may be maintained at the desired value by control of the temperature in the hydrocracking stage which will normally be in the range 600° to 800° F. (about 315° to 430° C.) and more usually in the range of about 650° to 750° F. (about 345° to 400° C.). Space velocity variations may also be used to control severity although this will be less common in practice in view of mechanical constraints on the system. Generally, the space velocity will be in the range of 0.25 to 2 LHSV, hr. $^{-1}$ and usually in the range of 0.5 to 1.5 LHSV.

A characteristic feature of the hydrocracking operation is the use of a bifunctional catalyst. In general terms, these catalysts include a metal component for promoting the desired aromatics saturation reactions and usually a combination of base metals is used, with one metal from Group VIII in combination with a metal of Group VIB. Thus, the base metal such as nickel or cobalt is used in combination with molybdenum or tungsten. The preferred combination is nickel/tungsten since it has been found to be highly effective for promoting the desired aromatics hydrocracking reaction. Noble metals such as platinum or palladium may be used since they have good hydrogenation activity in the absence of sulfur but they will normally not be preferred. The amounts of the metals present on the catalyst are conventional for lube hydrocracking catalysts of this type and generally will range from 1 to 10 weight percent of the Group VIII metal and 10 to 30 weight percent of the Group VI metal, based on the total weight of the catalyst. If a noble metal component such as platinum or palladium is used instead of a base metal such as nickel or cobalt, relatively lower amounts are in order in view of the higher hydrogenation activities of these noble metals, typically from about 0.5 to 5 weight percent being sufficient. The metals may be incorporated by any suitable method including impregnation onto the porous support after it is formed into particles of the desired size or by addition to a gel of the support materials prior to calcination. Addition to the gel is a preferred technique when relatively high amounts of the metal components are to be added e.g. above 10 weight percent of the Group VIII metal and above 20 weight percent of the Group VI metal. These techniques are conventional in character and are employed for the production of lube hydrocracking catalysts.

The metal component of the catalyst is generally supported on a porous, amorphous metal oxide support and alumina is preferred for this purpose although silica-alumina may also be employed. Other metal oxide components may also be present in the support although their presence is less desirable. The support may be fluorided. Consistent with the requirements of a lube hydrocracking catalyst, the support should have a pore size and distribution which is adequate to permit the relatively bulky components of the high boiling feeds to enter the interior pore structure of the catalyst where the desired hydrocracking reactions occur. To this extent, the catalyst will normally have a minimum pore size of about 50 Å i.e with no less than about 5 percent of the pores having a pore size less than 50 Å pore size, with the majority of the pores having a pore size in the range of 50–400 Å (no more than 5 percent having a pore size above 400 Å), preferably with no more than about 30 percent having pore sizes in the range of 200–400 Å. Preferred catalysts for the first stage have at least 60 percent of the pores in the 50–200 Å range. The pore size distribution and other properties of some typical lube hydrocracking (LHDC) catalysts suitable for use in the hydrocracking are shown in Table 3 below:

TABLE 3

LHDC Catalyst Properties

| Form | 1.5mm cyl. | 1.5 mm. tri. | 1.5 mm.cyl. |
|---|---|---|---|
| Pore Volume, cc/gm | 0.331 | 0.453 | 0.426 |
| Surface Area, $m^2$/gm | 131 | 170 | 116 |
| Nickel, wt. pct. | 4.8 | 4.6 | 5.6 |
| Tungsten, wt. pct. | 22.2 | 23.8 | 17.25 |
| Fluorine, wt. pct. | — | — | 3.35 |
| $SiO_2/Al_2O_3$ binder | — | — | 62.3 |
| Real Density, gm/cc | 4.229 | 4.238 | 4.023 |
| Particle Density, gm/cc | 1.744 | 1.451 | 1.483 |
| Packing Density, gm/cc | 1.2 | 0.85 | 0.94 |

If necessary in order to obtain the desired conversion, the catalyst may be promoted with fluorine, either by incorporating fluorine into the catalyst during its preparation or by operating the hydrocracking in the presence of a fluorine compound which is added to the feed. Fluorine containing compounds may be incorporated into the catalyst by impregnation during its preparation with a suitable fluorine compound such as ammonium fluoride ($NH_4F$) or ammonium bifluoride ($NH_4F.HF$) of which the latter is preferred. The amount of fluorine used in catalysts which contain this element is preferably from about 1 to 10 weight percent, based on the total weight of the catalyst, usually from about 2 to 6 weight percent. The fluorine may be incorporated by adding the fluorine compound to a gel of the metal oxide support during the preparation of the catalyst or by impregnation after the particles of the catalyst have been formed by drying or calcining the gel. If the catalyst contains a relatively high amount of fluorine as well as high amounts of the metals, as noted above, it is preferred to incorporate the metals and the fluorine compound into the metal oxide gel prior to drying and calcining the gel to form the finished catalyst particles.

The catalyst activity may also be maintained at the desired level by in situ fluoriding in which a fluorine compound is added to the stream which passes over the catalyst in this stage of the operation. The fluorine compound may be added continuously or intermittently to the feed or, alternatively, an initial activation step may be carried out in which the fluorine compound is passed over the catalyst in the absence of the feed e.g. in a stream of hydrogen in order to increase the fluorine content of the catalyst prior to initiation of the actual hydrocracking. In situ fluoriding of the catalyst in this way is preferably carried out to induce a fluorine content of about 1 to 10 percent fluorine prior to operation, after which the fluorine can be reduced to maintenance levels sufficient to maintain the desired activity. Suitable compounds for in situ fluoriding are orthofluorotoluene and difluoroethane.

The metals present on the catalyst are preferably used in their sulfide form and to this purpose pre-sulfiding of the catalyst should be carried out prior to initiation of the hydrocracking. Sulfiding is an established technique and it is typically carried out by contacting the catalyst with a sulfur-containing gas, usually in the presence of hydrogen. The mixture of hydrogen and hydrogen sulfide, carbon disulfide or a mercaptan such as butol mercaptan is conventional for this purpose. Presulfiding may also be carried out by contacting the catalyst with hydrogen and a sulfur-containing hydrocarbon oil such as a sour kerosene or gas oil.

Hydroisomerization

The paraffinic components present in the original wax feed possess good V.I. characteristics but have relatively high pour points as a result of their paraffinic nature. The objective of this invention is, therefore, to effect a selective conversion of waxy species while minimizing conversion of more branched species characteristic of lube components. The conversion of wax occurs preferentially by isomerization to form more branched species which have lower pour points and cloud points. Some degree of cracking accompanies isomerization and cracking is required to produce very low pour point lube oils.

Hydroisomerization Catalyst

The catalyst used in this hydroisomerization invention is one which has a high selectivity for the isomerization of waxy, linear or near linear paraffins to less waxy, isoparaffinic products. Catalysts of this type are bifunctional in character, comprising a metal component on a large pore size, porous support of relatively low acidity. The acidity is maintained at a low level in order to reduce conversion to products boiling outside the lube boiling range during this stage of the operation. In general terms, the catalyst should have an alpha value below 20 prior to metals addition, with preferred values below 10, and more preferred values below 5.

The alpha value is an approximate indication of the catalytic cracking activity of the catalyst compared to a standard catalyst. The alpha test gives the relative rate constant (rate of normal hexane conversion per volume of catalyst per unit time) of the test catalyst relative to the standard catalyst which is taken as an alpha of 1 (Rate Constant=0.016 sec $^{-1}$). The alpha test is described in U.S. Pat. No. 3,354,078 and in *J. Catalysis,* 4, 527 (1965); 6, 278 (1966); and 61, 395 (1980), to which reference is made for a description of the test. The experimental conditions of the test used to determine the alpha values referred to in this specification include a constant temperature of 538° C. and a variable flow rate as described in detail in *J. Catalysis,* 61, 395 (1980).

The hydroisomerization catalyst comprises a large pore zeolite metal. The large pore zeolite is supported by a porous binder. Large pore zeolites usually have at least one pore channel consisting of twelve-membered oxygen rings. Large pore zeolites usually have at least one pore channel with a major dimension greater than 7A and a Constraint Index of less than 1. Zeolites suitable for use in the instant invention are listed below:

| | CI (at test temperature) |
|---|---|
| ZSM-4 | 0.5 (316° C.) |
| MCM-22 | 0.6–1.5 (399° F.–454° C.) |
| TEA Mordenite | 0.4 (316° C.) |
| REY | 0.4 (316° C.) |
| Amorphous Silica-alumina | 0.6 (538° C.) |
| Dealuminized Y | 0.5 (510° C.) |
| Zeolite Beta | 0.6–2.0 (316° C.–399° C.) |
| ZSM-20 | 0.5 (371° C.) |
| Mordenite | 0.5 (316° C.) |

The preferred hydroisomerization catalyst employs zeolite beta since this zeolite has been shown to possess outstanding activity for paraffin isomerization in the presence of aromatics, as disclosed in U.S. Pat. No. 4,419,220. Zeolite beta possesses a constraint index between 0.60 and 2.0 at temperatures between 316° C. and 399° C. although Constraint Indexes less than 1 are preferred. The low acidity forms of zeolite beta used in this invention may be obtained by synthesis of a highly siliceous form of the zeolite e.g with a silica-alumina ratio above about 500:1. The catalysts of this invention are prepared in the absence of boron. The absence of boron simplifies preparation of the catalyst and facilitates later addition of phosphorus. Steaming zeolites of lower silica-alumina ratio to the requisite acidity level has been used in the prior art to increase the silica-alumina ratio, however, steamed catalysts are not effective in the instant invention. They may also be obtained by extraction with acids such as dicarboxylic acid, as disclosed in U.S. Pat. No. 5,200,168. This patent discloses the synthesis of dealuminated zeolite beta by oxalic acid extraction. U.S. Pat. No. 5,238,677 discloses the synthesis of dealuminated mordenite by oxalic acid extracting. U.S. Pat. No. 5,164,169 discloses the preparation of highly siliceous zeolite beta employing a chelating agent such as tertiary alkenolamines in the synthesis mixture.

The zeolites of this invention possess a framework silica-alumina ratio of 50:1 or above. Preferably the silica-alumina ratio is above 200:1 and more preferably the silica-alumina ratio is greater than 600:1. In the prior art, the desired silica-alumina ratio was obtained by severely steaming the catalyst. The high-silica alumina ratio is obtained, in this invention however, by preparing the catalyst as described in U.S. Pat. No. 5,232,579. A catalyst may be synthesized with a high silica-alumina ratio. The catalyst which is synthesized with a high silica-alumina ratio provides superior results to a steamed catalyst in this invention.

Catalyst Properties

Catalyst acidity may be reduced by the introduction of nitrogen compounds, e.g. $NH_3$ or organic nitrogen compounds, with the feed to the hydroisomerization catalyst. However, the total nitrogen content of the feed should not exceed 100 ppm and should be preferably less than 20 ppm. The catalyst may also contain metals which reduce the number of strong acid sites of the catalyst and improve the selectivity of isomerization reactions to cracking reactions. Metals which are preferred for this purpose are those belong to the class of Group 1A and Group IIA metals such as potassium, calcium and magnesium.

The zeolite will be composites with a matrix material to form the finished catalyst and for this purpose conventional very low-acidity matrix materials such as alumina, silica-alumina and silica are suitable although aluminas such as alpha boehmite (alpha alumina monohydrate) may also be used, provided that they do not confer any substantial degree of acidic activity on the matrixed catalyst. The zeolite is usually composites with the matrix in amounts from 80:20 to 20:80 by weight, typically from 80:20 to 50:50 zeolite:matrix. Compositing may be done by conventional means including mulling the materials together followed by extrusion into the desired finished catalyst particles. A preferred method for extruding the zeolite with silica as a binder is disclosed in U.S. Pat. No. 4,582,815. If the catalyst is to be steamed in order to achieve the desired low acidity, it is performed after the catalyst has been formulated with the binder, as is conventional. The preferred binder for the steamed catalyst is alumina.

The hydroisomerization catalyst also includes a metal component in order to promote the desired hydroisomerization reactions which, proceeding through unsaturated transitional species, require mediation by a hydrogenation-dehydrogenation component. In order to maximize the isomerization activity of the catalyst, metals having a strong hydrogenation function are preferred and for this reason, platinum and the other noble metals such as rhenium, gold, and palladium are given a preference. The amount of the noble metal hydrogenation component is typically in the range 0.1 to 5 weight percent of the total catalyst, usually from 0.1 to 2 weight percent. The platinum may be incorporated into the catalyst by conventional techniques including ion exchange with complex platinum cations such as platinum tetraamine or by impregnation with solutions of soluble platinum compounds, for example, with platinum tetraammine salts such as platinum tetraamminechloride. The catalyst may be subjected to a final calcination under conventional conditions in order to convert the noble metal to its reduced form and to confer the required mechanical strength on the catalyst. Prior to use the catalyst may be subjected to presulfiding as described above for the hydrocracking pretreatment catalyst.

Hydroisomerization Conditions

The conditions for the hydroisomerization step (also called the isomerization step) are adjusted to achieve the objective of isomerizing the waxy, linear and near-linear paraffinic components in the waxy feed to less waxy but high V.I. isoparaffinic materials of relatively lower pour point. This end is achieved while minimizing conversion to non-lube boiling range products (usually 650° F.–(345° C. –) materials). Since the catalyst used for the hydroisomerization has a low acidity, conversion to lower boiling products is usually at a relatively low level and by appropriate selection of severity, the operation of the process may be optimized for isomerization over cracking. At conventional space velocities of about 1, using a Pt/zeolite beta catalyst with an alpha value below 20, temperatures for the hydroisomerization will typically be in the range of about 570° to about 780° F. (about 300° to 415° C.) with conversion to 650° F. – typically being from about 5 to 30 weight percent, more usually 10 to 25 weight percent, of the waxy feed. Approximately 40 to 90 percent of the wax in the feed is converted in the isomerization step. However, temperatures may be used outside this range, for example, as low as about 500° F. (260° C.) and up to about 800° F. (about 425° C.) although the higher temperatures will usually not be preferred since they will be associated with a lower isomerization selectivity and the production of less stable lube products as a result of the hydrogenation reactions being thermodynamically less favored at progressively higher operating temperatures. Space velocities will typically be in the range of 0.5 to 2 LHSV (hr. $^{-1}$). The pour point of the effluent from the hydroisomerization step is in the range from 30° to 110° F., preferably in the range from 40° to 100° F.

The hydroisomerization is operated at hydrogen partial pressures (reactor inlet) of at least 800 psig (about 5516 KPa), usually 800 to 3000 psig (5516 to 20785 kPa) and in most cases 800–2500 psig (5516 to 17340 kPa). Hydrogen circulation rates are usually in the range of about 500 to 5000 SCF/Bbl (about 90 to 900 n.l.l. $^{-1}$). Since some saturation of aromatic components present in the original feed takes place in the presence of the noble metal hydrogenation component on the catalyst, hydrogen is consumed in the hydroisomerization even though the desired isomerization reactions are in hydrogen balance; for this reason, hydrogen circulation rates may need to be adjusted in accordance with the aromatic content of the feed and also with the temperature used in the hydroisomerization since higher temperatures will be associated with a higher level of cracking and, consequently, with a higher level of olefin production, some of which will be in the lube boiling range so that product stability will need to be assured by saturation. Hydrogen circulation rates of at least 1000 SCF/Bbl (about 180 n.l.l. $^{-1}$) will normally provide sufficient hydrogen to compensate for the expected hydrogen consumption as well as to ensure a low rate of catalyst aging.

An interbed quench is desirable to maintain temperature in the process. Cold hydrogen is generally used as the quench, but a liquid quench, usually recycled product, may also be used.

Dewaxing

Although a final dewaxing step will normally be necessary in order to achieve the desired product pour point, it is a notable feature of the present process that the extent of dewaxing required is relatively small. Typically, the loss during the final dewaxing step will be no more than 15–20 weight percent of the dewaxer feed and may be lower. Either catalytic dewaxing or solvent dewaxing may be used at this point and if a solvent dewaxer is used, the removed wax may be recycled to the hydroisomerization for a second pass through the isomerization step. The demands on the dewaxer unit for the product are relatively low and in this respect the present process provides a significant improvement over the process employing solely amorphous catalysts where a significant degree of dewaxing is required. The high isomerization selectivity of the zeolite catalysts enables high single pass wax conversions to be achieved, typically about 80% as compared to 50% for the amorphous catalyst process so that unit throughput is significantly enhanced.

A shape-selective dewaxing catalyst maybe alternately employed rather than a solvent dewaxing approach. This catalyst removes the n-paraffins together with the waxy, slightly branched chain paraffins, while leaving the more branched chain iso-paraffins in the process stream. Shape-selective catalytic dewaxing processes employ catalysts which are more highly selective for removal of n-paraffins and slightly branched chain paraffins than is the isomerization catalyst, zeolite beta. This phase of the synergistic process is therefore carried out as described in U.S. Pat. No. 4,919,788, to which reference is made for a description of this phase. The catalytic dewaxing step in the present process is carried out with a constrained, shape selective dewaxing catalyst based on a constrained intermediate pore crystallines material, such as an alumino-phosphate. A constrained intermediate crystalline material has at least one channel of 10-membered oxygen rings with any intersecting channel having 8-membered rings. ZSM-23 is the preferred zeolite for this purpose although other highly shape-selective zeolites such as ZSM-22 or the synthetic ferrierite ZSM-35 may also be used, especially with lighter stocks. Silicoaluminophosphates such as SAPO-11 and SAPO-41 maybe used as selective dewaxing catalysts.

The preferred catalysts for use as the dewaxing catalysts are the relatively constrained intermediate pore size zeolites. Such preferred zeolites have a Constraint Index in the range of 1–12, as determined by the method described in U.S. Pat. No. 4,016,218. These preferred zeolites are also characterized by specific sorption properties related to their relatively constrained diffusion characteristics. These sorption characteristics are those which are set out in U.S. Pat. No. 4,810,357 for the zeolites such as zeolite ZSM-22, ZSM-23, ZSM-35 and ferrierite. These zeolites have pore openings which result in a specific combination of sorption properties, namely, (1) a ratio of sorption of n-hexane to o-xylene, on a volume percent basis, of greater than about 3, wherein sorption is determined at a $P/P_o$ of 0.1 and at a temperature of 50° C. for n-hexane and 80° C. for o-xylene and (2) by the ability of selectively cracking 3-methylpentane (3MP) in preference to the doubly branched 2,3-dimethylbutane (DMB) at 1000° F. and 1 atmosphere pressure from a 1/1/1 weight ratio mixture of n-hexane/3-methylpentane/2,3-dimethylbutane, with the ratio of rate constants $k_{3MD}/k_{DMB}$ determined at a temperature of 1000° F. being in excess of about 2.

The expression, "$P/P_o$", is accorded its usual significance as described in the literature, for example, in "The Dynamical Character of Adsorption" by J. H. deBoer, 2nd Edition, Oxford University Press (1968) and is the relative pressure defined as the ratio of the partial pressure of sorbate to the vapor pressure of sorbate at the temperature of sorption. The ratio of the rate constants, $k_{3MP}/k_{DMB}$, is determined from 1st order kinetics, in the usual manner, by the following equation:

$$k=(1/T_c)\ 1n\ (1/1-\epsilon)$$

where k is the rate constant for each component, $T_c$ is the contact time and $\epsilon$ is the fractional conversion of each component.

Zeolites conforming to these sorption requirements include the naturally occurring zeolite ferrierite as well as the synthetic zeolites ZSM-22, ZSM-23 and ZSM-35. These zeolites are at least partly in the acid or hydrogen form when they are used in the present process.

The preparation and properties of zeolite ZSM-22 are described in U.S. Pat. No. 4,810,357 (Chester) to which reference is made for such a description.

The synthetic zeolite ZSM-23 is described in U.S. Pat. Nos. 4,076,842 and 4,104,151 to which reference is made for a description of this zeolite, its preparation and properties.

The intermediate pore-size synthetic crystalline material designated ZSM-35 ("zeolite ZSM-35"or simply "ZSM-35"), is described in U.S. Pat. No. 4,016,245, to which reference is made for a description of this zeolite and its preparation. The synthesis of SAPO-11 is described in U.S. Pat. Nos. 4,943,424 and 4,440,871. The synthesis of SAPO-41 is described in U.S. Pat. No. 4,440,871.

Ferrierite is a naturally-occurring mineral, described in the literature, see, e.g., D. W. Breck, ZEOLITE MOLECULAR SIEVES, John Wiley and Sons (1974), pages 125–127, 146, 219 and 625, to which reference is made for a description of this zeolite.

The dewaxing catalysts used in the shape-selective catalytic dewaxing include a metal hydrogenation-dehydrogenation component. Although it may not be strictly necessary to promote the selective cracking reactions, the presence of this component has been found to be desirable to promote certain isomerization reactions which contribute to the synergy of the two catalyst dewaxing system. The presence of the metal component leads to product improvement, especially VI, and stability as well as helping to retard catalyst aging. The shape-selective, catalytic dewaxing is normally carried out in the presence of hydrogen under pressure. The metal will be preferably platinum or palladium. The amount of the metal component will typically be 0.1 to 10 percent by weight. Matrix materials and binders may be employed as necessary. Table 5 illustrates the properties of a ZSM-23 catalyst containing Pt.

Shape selective dewaxing using the highly constrained, highly shape-selective catalysts may be carried out in the same general manner as other catalytic dewaxing processes, such as those described above for the initial isomerization phase. Conditions will therefore be of elevated temperature and pressure with hydrogen, typically at temperatures from 250° to 500° C. (about 580° F. to 930° F.), more usually 300° to 450° C. (about 570° F. to 840° F.) and in most cases not higher than about 370° C. (about 700° F.). Pressures extend up to 3,000 psi, and more usually up to 2500 psi. Space velocities extend from 0.1 to 10 hr. $^{-1}$ (LHSV), more usually 0.2 to 5 hr $^{-1}$. Hydrogen circulation rates range from 500 to 1000 n.l.l. $^{-1}$, and more usually 200 to 400 n.l.l. $^{-1}$. Reference is made to U.S. Pat. No. 4,919,788 for a more extended discussion of the shape-selective catalytic dewaxing step. As indicated previously, hydrogen may be used as an interbed quench in order to provide maximum temperature control in the reactor. Example 6 and FIG. 4, infra illustrate the effectiveness of employing ZSM-23 in combination with zeolite beta in an integrated catalyst system. Pt/ZSM-23, although primarily a shape selective catalyst, adds incremental isomerization capability.

The degree of conversion to lower boiling species in the dewaxing stage will vary according to the extent of dewaxing desired at this point, i.e. on the difference between the target pour point and the pour point of the effluent from the isomerization stage. It will also depend upon the selectivity of the shape-selective catalyst which is used. At lower product pour points, and with relatively less selective dewaxing catalysts, higher conversions and correspondingly higher hydrogen consumptions will be encountered. In general terms conversion to products boiling outside the lube range, e.g. 315° C.–, more typically 343° C.–, will be at least 5 weight percent, and in most cases at least 10 weight percent, with conversions of up to about 30 weight percent being necessary only to achieve the lowest pour points with catalysts of the required selectivity. Boiling range conversion on a 650° F.+ (343° C.+) basis will usually be in the range of 10–25 weight percent.

After the pour point of the oil has been reduced to the desired value by selective dewaxing, the dewaxed oil may be subjected to treatments such as hydrotreating, in order to remove color bodies and produce a lube product of the desired characteristics. Fractionation may be employed to remove light ends and to meet volatility specifications.

It is apparent that the highly advantageous results achieved with the present process in terms of lube yield, V.I., and other product properties can be ascribed to the synergistic functioning of the two catalytic phases, isomerization and catalytic dewaxing. In the first phase the large pore zeolite acts more preferentially than conventional dewaxing catalysts on the high molecular weight waxy species in the feed, i.e. the back end of the feed, isomerizing them with minimal cracking. These high molecular weight waxy species, if not removed nearly completely in the dewaxing process, contribute to high cloud point and a hazy appearance at near-ambient temperatures. Because access to the pore structure of the large pore zeolite is less restricted than the pore structures of conventional dewaxing catalysts, a large pore zeolite is not able to dewax the feed to low pour point (less than 10° F.) without incurring significant yield and V.I. losses due to cracking of branched species. However, zeolite beta is effective for selectively converting bulky wax molecules when operated to convert 40% to 90%, more preferably 50% to 80%, of the wax in the feed to the two-stage dewaxing process. The pour point of the product exiting the isomerization step, on an approximate 650° F.+ basis, will depend on the nature of the feedstock but is typically between 40° F. and 90° F. The intermediate pore size catalysts are, by contrast, more effective at removing the waxes in the front end (low boiling components) of the feed. As Example 6 and FIG. 4 infra illustrate, intermediate pore size molecular sieves such as Pt/ZSM-23 possesses incremental isomerization capabilities in addition to shape-selective dewaxing capabilities. Thus, by applying these properties of the intermediate pore size molecular sieves in combination with the properties of a large pore zeolites as described above, it has become possible to evolve a synergistic catalytic dewaxing process which makes the most effective use of the two types of zeolites. A large pore zeolite is used in an initial stage to convert waxy paraffins to less waxy iso-paraffins by isomerization, acting preferentially on the waxy components in the back end of the feed. The partly dewaxed feed is then processed over an intermediate pore size zeolite to convert the residual waxy components so that the final product has a low pour point and low cloud point.

Products

The products from the process are high VI, low pour point materials which are obtained in excellent yield. Besides having excellent viscometric properties they are also highly stable, both oxidatively and thermally and to ultraviolet light. VI values in the range of 130 to 150 are typically obtained. The preferred wax feeds to the process have values of at least 140, typically 143 to 147. These values are readily achievable with product yields of at least 50 weight percent, usually at least 60 weight percent, based on the original wax feed, corresponding to wax conversion values of almost 80 to 90 percent, respectively.

EXAMPLES

Example 1

A slack wax having properties summarized in the Table infra was processed over a NiW/fluorided alumina catalyst at the following conditions:

| | |
|---|---|
| LHSV, $hr^{-1}$ | 1 |
| Pressure, psig | 2000 |
| $H_2$ circulation, SCF/B | 7500 |

Conversion of material in the feed boiling above 650° F. was 11 wt %.

TABLE 6

| Feedstock Properties | Mildly Hydrocracked Coryton 450 Heavy Neutral Slack Wax |
|---|---|
| Oil Content, wt % | 34 |
| Nitrogen, ppmw | 32 |
| Sulfur, wt % | 0.12 |
| 650° F.+ Dewaxed Oil Properties | |
| KV @ 100° C. cst | 10.53 |
| VI | 96 |
| Pour Point, °F. | 0 |
| Lube Yield, wt % on fresh feed | 34 |

Example 2

A low acidity Beta catalyst was prepared by first extruding a 65% 600:1 $SiO_2/Al_2O_3$ Beta on 35% SiO2 as a 1/16 inch cylindrical extrudate. The method used to prepare the 600:1 $SiO_2/Al_2O_3$ Beta zeolite is described in U.S. Pat. No. 5,232,579.

The catalyst was then steamed to an alpha less than 15. This catalyst was subsequently exchanged with a buffered solution of platinum tetrammine chloride to a target level of 0.6 wt % Pt. The ability of the catalyst to hydrogenate benzene was measured to indicate the metal activity and dispersion. The activity was about 400 moles of benzene per mole of platinum per hour at 100° C. and a $H_2$ to benzene ratio of 100. The catalyst was sized and loaded in a fixed bed reactor. Prior to this introduction of hydrocarbon feeds, the catalyst was sulfided at 500 psi with a 2% $H_2S/H_2$ gas mixture.

Example 3

The hydrocracked wax described in Example 1 was processed over the catalyst described in Example 2 at the following conditions and was subsequently solvent dewaxed:

| | |
|---|---|
| LHSV, $hr^{-1}$ | 1 |
| Pressure, psig | 2000 |

Available performance data after dewaxing is summarized below.

| Temp, °C. | Yield | KV @ 100° C. | VI | Pour Pt. °F |
|---|---|---|---|---|
| 344 | 54 | 5.47 | 146 | 5 |
| 340 | 50 | 5.47 | 146 | 0 |
| 350 | 58 | 5.45 | 145 | 15 |

This table will be updated with more current performance data as those data become available.

Example 4

A sample of wax was hydrocracked at conditions similar to those in Example 1. The hydrocracked wax was processed over a 0.6 wt % Pt/silica-alumina catalyst. Run conditions are summarized below:

| | |
|---|---|
| LHSV, $hr^{-1}$ | 1 |
| Pressure, psig | 1750 |
| $H_2$ Circulation, SCF/B | 3500 |

Performance data is summarized below.

| Temp, °C. | Yield | KV @ 100° C. | VI | Pour Pt. °F |
|---|---|---|---|---|
| 323 | 39 | 4.25 | 136 | 5 |
| 315 | 46 | 4.41 | 140 | 5 |
| 300 | 40 | 5.07 | 139 | −5 |

Note that both yield and VI of the lubricant product are below that attainable with the high $SiO_2/Al_2O_3$ Beta catalyst.

What is claimed is:

1. A process for producing a high Viscosity Index (VI) lubricant having a VI of at least 125 from a waxy hydrocarbon feed having a wax content of at least 40%, which comprises catalytically dewaxing waxy paraffins present in the feed primarily by isomerization, in the presence of hydrogen and in the presence of a low acidity large pore zeolite isomerization catalyst having a ratio of $SiO_2/Al_2O_3$, as synthesized, of at least 50:1, an alpha value of not more than 20 and further comprises a noble metal hydrogenation component wherein the catalyst is prepared in the absence of boron.

2. The process of claim 1 wherein the large-pore zeolite possesses at least one pore channel of 12-membered oxygen rings.

3. The process of claim 1, wherein the large pore zeolite is zeolite beta.

4. The process of claim 1, wherein the ratio of $SiO_2/Al_2O_3$ is at least 200:1.

5. The process of claim 4, wherein the ratio of $SiO/Al_2O_3$ is at least 600:1.

6. The process of claim 1, in which the noble metal of the hydrogenation component is Pt or Pd.

7. The process of claim 1, in which the noble metal content of the hydrogenation catalyst is in the range from about 0.1 to 2 wt %.

8. The process of claim 1 in which the feed comprises a waxy hydrocarbon feed having a wax content of at least 50 wt % and an aromatic content of least than 25 wt %.

9. The process of claim 1 wherein the feedstock is selected from the group consisting of a slack wax, deoiled wax, wax from Fischer-Tropsch process, petrolatum, vacuum gas oil, or a raffinate from solvent extraction of a vacuum distillate.

10. The process of claim 1, in which the process is carried out in the presence of hydrogen.

11. The process of claim 10, in which the wax conversion is from 40 to 90 wt. % of the wax contained in the feed.

12. The process of claim 9, in which the wax conversion is from 50 to 80 wt % based on the feed.

13. The process of claim 1, wherein the effluent has a pour point which ranges from about 30° to about 100° F.

14. The process of claim 1, wherein conditions include a hydrogen partial pressure ranging from 600 to 3000 psig and a temperature from 550° to 800° F.

15. The process of claim 1, wherein the preferred range of VI is from 130 to 150.

16. The process of claim 1 in which the effluent is subjected to further dewaxing to achieve target pour point, with a yield loss during dewaxing of not more than 15 wt %.

17. The process of claim 16, in which dewaxing is accomplished by either solvent or catalytic means.

18. The process of claim 1, in which the effluent is hydrotreated by contacting it with a catalyst comprising a metal hydrogenation component on an amorphous, porous support material at a pressure in the range from about 500 to about 3000 psig, a reaction temperature in the range from about 500° F. to about 800° F., a space velocity which is in a range from about 0.1 to about 10 LHSV, and a once-through hydrogen circulation rate which extends from about 1000 SCF/B to about 10,000 SCF/B, in order to improve the thermal and oxidative stability of the lubricant.

19. A process for producing a high Viscosity Index (VI) lubricant having a VI of a least 125 from a waxy hydrocarbon feed having a wax content of at least 40 wt %, the process comprising the following steps:

(a) hydrocracking of the feed in order to reduce its nitrogen as well as to remove napthenic and aromatic components, thereby improving VI, the hydrocracking process comprising contacting the feed with a catalyst composed of a metal hydrogenation component on an acidic support;

(b) catalytically dewaxing waxy paraffins present in the feed primarily by isomerization, in the presence of hydrogen and in the presence of a low acidity large pore zeolite isomerization catalyst having a ratio of $SiO_2/Al_2O_3$, as synthesized, of at least 50:1, the catalyst possessing an alpha value of not more than 20 and further comprising a noble metal hydrogenation component wherein the catalyst is prepared in the absence of boron.

20. The process of claim 19 wherein the large-pore zeolite possesses at least one pore channel of 12-membered oxygen rings.

21. The process of claim 19, wherein the large pore zeolite is zeolite beta.

22. The process of claim 19, wherein the ratio of $SiO_2/Al_2O_3$ is at least 200:1.

23. The process of claim 21, wherein the ratio of $SiO_2/Al_2O_3$ is at least 600:1.

24. The process of claim 19 wherein the feedstock is selected from the group consisting of a slack wax, deoiled wax, wax from Fischer-Tropsch process, petrolatum, vacuum gas oil, and a raffinate from solvent extraction of a vacuum distillate.

25. The process of claim 19 wherein conditions include a hydrogen partial pressure ranging from 600 to 3000 psig and a temperature from 550° to 800° F.

26. The process of claim 19, wherein the preferred range of VI is from 130 to 150.

27. The process of claim 19 in which the effluent of step (b) is subjected to further dewaxing to achieve target pour point, with a loss during dewaxing of not more than 15 wt %.

28. The process of claim 19, in which the effluent of step (b) is hydrotreated by contacting it with a catalyst comprising a metal hydrogenation component on an amorphous porous support material at a pressure in the range from about 500 to about 3000 psig, a reaction temperature in the range from about 500° F. to about 800° F., a space velocity which is in a range from about 0.1 to about 10 LHSV, and a once-through hydrogen circulation rate which extends from about 1000 SCF/B SCF/B to about 10,000 SCF/B, in order to improve the thermal and oxidative stability of the lubricant.

29. A process for producing a high Viscosity Index (VI) lubricant having a VI of at least 120 from a waxy hydrocarbon feed having a wax content of at least 30 wt %, the process employing two catalysts operating synergistically, and comprising the following steps:

(a) hydrocracking of the feed in order to reduce its nitrogen content as well as to remove naphthenic and aromatic components, thereby improving VI, the hydrocracking process comprising contacting the feed with a catalyst composed of a metal hydrogenation component on an acidic support;

(b) catalytically dewaxing waxy paraffins present in the feed primarily by isomerization, in the presence of hydrogen and in the presence of a low acidity large pore zeolite isomerization catalyst having a ratio of $SiO_2/Al_2O_3$, as synthesized, of at least 50:1, the catalyst possessing an alpha value of not more than 20 and further comprising a noble metal hydrogenation component wherein the catalyst is prepared in the absence of boron;

(c) subjecting the effluent of the initial catalytic dewaxing step to a second catalytic dewaxing step in which the effluent is contacted with a constrained intermediate pore crystalline material, which contains a metal hydrogenation dehydrogenation component.

* * * * *

UNITED STATES PATENT AND TRADEMARK OFFICE

CERTIFICATE OF CORRECTION

PATENT NO. : 5,885,438

DATED : March 23, 1999

INVENTOR(S) : Apelian et al.

It is certified that error appears in the above-identified patent and that said Letters Patent is hereby corrected as shown below:

Claim 28, column 18, line 60 delete the second occurrence of "SCF/B"

Signed and Sealed this

Twenty-seventh Day of July, 1999

*Attest:*

Q. TODD DICKINSON

*Attesting Officer*

*Acting Commissioner of Patents and Trademarks*